US005399245A

United States Patent [19]

Fedkiw, Jr.

[11] Patent Number: 5,399,245

[45] Date of Patent: Mar. 21, 1995

[54] METHODS OF INDIRECT ELECTROCHEMISTRY USING IONOMER COATED ELECTRODES

[75] Inventor: Peter S. Fedkiw, Jr., Wake County, N.C.

[73] Assignee: North Carolina State University, Raleigh, N.C.

[21] Appl. No.: 116,338

[22] Filed: Sep. 3, 1993

[51] Int. Cl.[6] ..... C25B 1/00

[52] U.S. Cl. ..... 204/59 R; 204/86

[58] Field of Search ..... 204/105 R, 290 R, 282, 204/97, 94, 112, 78, 59 R, 86

[56] References Cited

U.S. PATENT DOCUMENTS 4,971,666 11/1990 Weinberg et al. ..... 204/59 R 5,007,989 4/1991 Nyberg et al. ..... 204/1.11

5,254,223 10/1993 Josowicz et al. ..... 204/59 R

*Primary Examiner*—John Niebling

*Assistant Examiner*—Brendan Mee

*Attorney, Agent, or Firm*—Flehr, Hohbach, Test, Albritton & Herbert

[57] ABSTRACT

Novel methods of indirect electrochemistry are provided. The methods use ionomer coated electrodes for regeneration of the redox reagent in the indirect electrochemical process. The electrode may be either directly coated with a thin ionomer coating, or alternatively may electrodeposited within an ionomer coated electronically conductive substrate. Ionomers used to coat the electrodes of the subject method include Nafion® and Tosflex®.

17 Claims, 3 Drawing Sheets

METHODS OF INDIRECT ELECTROCHEMISTRY USING IONOMER COATED ELECTRODES

TECHNICAL FIELD

The field of this invention is indirect electrochemistry.

BACKGROUND OF THE INVENTION

Metal based redox reagents are used extensively in the chemical process industry (CPI) in organic homogenous reactions. The metal based redox reagents used by the CPI may be synthesized either chemically or electrochemically. Current CPI practice is to use a particular redox reagent once and then discard it, thus significantly increasing the cost for a particular manufacturing process.

Indirect electrochemistry has potential usefulness in the CPI because the redox reagents used in a particular chemical process are regenerated. The regenerated redox reagents can be reused for further homogenous chemical reactions, unlike conventional synthetic chemistry where the redox reagents are discarded after use. Thus, use of indirect electrochemistry could significantly lower overall chemical process costs. However, indirect electrochemistry has, as yet, found only limited application in the chemical process industry.

A reason for this limited use is that small amounts of organic contaminants, during the indirect electrochemical process, partition into the aqueous phase from the organic phase. These organic contaminants contact the surface of the electrode and thereby lower the electric current efficiency of regeneration of the redox reagent to levels which make indirect electrochemistry unattractive for use in CPI.

In the limited situations where indirect electrochemistry has been used in the CPI, various mass transfer steps have been employed to remove the organic contaminants from the aqueous phase prior to exposure of the aqueous phase to the electrode. These steps serve to lower the deleterious effects of the organic contaminants on the electric current efficiency of regeneration of the redox reagent. These steps include liquid-liquid separation of the aqueous phase from the organic phase before the aqueous phase reaches the electrode, cooling the aqueous phase before it reaches the electrode to crystallize, and thus remove, organic contaminants, and activated carbon adsorption of the organic contaminant from the aqueous phase. However, these additional steps can increase the complexity, as well as the cost, of the overall system and thus lower the viability of indirect electrochemistry as a useful tool to the CPI.

Another step which would diminish the deleterious effect of the organic contaminants would be to coat the electrode to inhibit passage of the contaminant to the electrode surface. Any coating of the electrode to inhibit passage of the organic contaminants from reaching the electrode surface would also inhibit the mass transport of the redox reagent to the surface of the electrode. Heretofore, no adequate coating has been recognized by the CPI which meets these two requirements.

Because of the long-term savings which would be realized if indirect electrochemistry were used in the CPI to regenerate redox reagents, there is a need to devise improved methods of indirect electrochemistry that would make indirect electrochemistry viable for use in the CPI. Such improvements would include ways to reduce the deleterious effect of organic contaminants on the electrode surface. Such improvements would allow indirect electrochemistry to be used in a variety of chemical synthesis applications which require homogenous chemical reactions with a redox reagent.

Relevant Literature

U.S. Pat. Nos. 4,498,942 and 4,929,313 describe various embodiments of ionomer coated electrodes for use in electrolytic devices.

Simonet, J. *Electrogenerated Reagents,* Organic Electrochemistry (1983) and Steckhan, E., *Organic Synthesis with Electrochemically Regenerable Redox Systems,* Topics in Current Chemistry (1987) provide reviews of the current methods of indirect electrochemistry used in the chemical process industry.

Moore et al., Anal. Chem. (1986) 48:2569 describe methods for the preparation of ionomer films and membranes. Moore et al., Macromolecules (1988) 21:1334 describe the morphological properties of ionomer films.

Ogumi et al., Bull. Chem. Soc. Jpn. (1988) 61: 4183–4187, describes Nafion®-platinum composite electrodes which have incorporated therein a ferric-ferrous couple for use in indirect electrochemistry. Ogumi et al., Bull. Chem. Soc. Jpn. (1987) 60:4233–4237 also describes an iron redox couple incorporated into a Nafion® coated platinum electrode. Matsue et al., Stud. Org. Chem. (1987) 30:397–400 describes Nafion® coated carbon electrodes suitable for use in detection devices.

Dolbhofer et al., Electrochim. Acta (1988) 33:453 and Dunsch et al., J. Electroanal. Chem. (1990) 280:313 discuss ionomer coated electrodes. Itaya et al., J. Electroanal. Chem. (1986) 208:373 and Itaya et al., Chem. Let. (1986) 571 describe composite structures of platinum electrodes deposited a Nafion® coated glassy carbon substrate.

Nagy et al., J. Electroanal. Chem. (1985) 188:85 describe the use of Nafion® coated electrodes in an analytical chemical application for the detection of cationic analytes.

SUMMARY OF THE INVENTION

Improved indirect electrochemical methods and apparatus suitable for use in the chemical process industry are provided. The improved methods comprise the use of ionomer coated electrodes for the regeneration of redox reactants. The electrode used for regeneration of the spent redox reactant may be either coated with an ionomer film or, in an alternative embodiment, electrodeposited within the ionomer film that coats an electronically conductive substrate. Ionomers that find use in the subject method include NAFION® (a cationic, perfluorinated membrane, see Aldrichimica Acta (1986) 19:76) and TOSFLEX® (an anionic, perfluorinated membrane). The ionomer coating of the subject method reduces the deleterious effect of organic contaminants in indirect electrochemical processes but simultaneously provides for efficient regeneration of redox reagents.

DESCRIPTION OF THE SPECIFIC EMBODIMENTS

Figure 1:
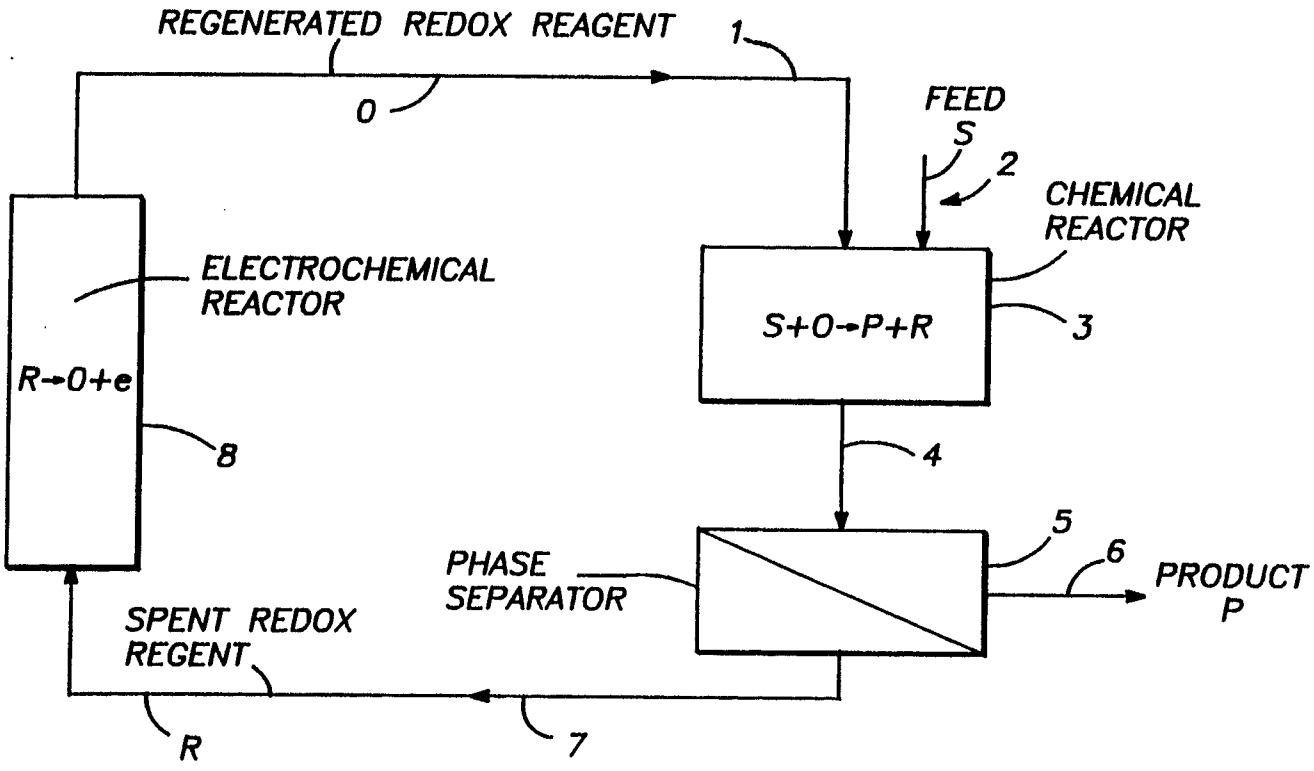
FIG. 1 is a flow diagram of an Ex-Cell indirect electrochemical process.

In accordance with the subject invention, novel methods of indirect electrochemistry are provided which use ionomer coated electrodes for regeneration of the redox reactant. Indirect electrochemistry is a useful process for the manufacture of organic chemicals. Broadly, indirect electrochemistry refers to the use of a redox reagent which can react with an organic reactant to form a product and a spent redox reagent. The spent redox reagent is then regenerated electrochemically for use in additional product formation reactions. The indirect electrochemical system can either be structured as an "Ex-Cell" or "In-Cell" system.

In an Ex-Cell system, a redox reactant is carried by an aqueous phase to an organic phase which comprises an organic reactant and solvent. The two phases are contacted in a chemical reactor, and at the interface of the aqueous and organic phases the redox reagent reacts with the organic reactant to form a product and spent redox reagent. The phases may be contacted by any convenient means, including mixing, stirring and the like. Upon contact of the redox reagent with the organic reactant, the two species react to form organic product and spent redox reagent. Following the reaction, the two phases are separated in a phase separator. While the organic product remains in the organic phase, the spent redox reagent is returned by the aqueous phase to an electrochemical reactor, which comprises the electrode, for regeneration. The electrode, either an anode or cathode, has a sufficient potential applied to it whereby upon contact of the spent redox reagent with the electrode, the redox reagent is regenerated. The amount of sufficient potential to be applied is dependent on the particular redox reagent employed for a particular process, and can be determined empirically. The regenerated redox reagent is then carried, via the aqueous stream, to the chemical reactor, to be used again in further reactions with additional organic reactant.

In-Cell systems, in contrast, do not comprise two different reactors. Instead, the chemical reaction of the redox reagent with organic reactant and the electrochemical regeneration of the spent redox reagent both occur in the same reactor vessel.

The subject invention provides for improved indirect electrochemical methods through use of ionomer coated electrodes to reduce the effects of organic contaminants in indirect electrochemical processes, and therefore make it viable for use in the CPI. The ionomer coating on the subject electrodes selectively allow for passage of the redox reagent to the surface of the electrode for regeneration, but significantly inhibit the passage of organic contaminants to the electrode surface.

The redox reagent used in the subject method serves to carry a charge from the electrode site to the reactant site, and may be cationic, anionic or neutral. A particular redox reagent may be either an oxidant or a reductant. Henceforth, the redox reagent will be referred to more particularly as a redox couple, which encompasses both the spent and regenerated form of the redox reagent, e.g. an oxidant and its reduced (spent) form. Suitable cationic redox couples include $Mn^{2+}/Mn^{3+}$, $Ce^{3+}/Ce^{4+}$, $Fe^{2+}/Fe^{3+}$, $Co^{2+}/Co^{3+}$, and the like. Suitable anionic redox couples include $Fe(CN)_6^{4-}/Fe(CN)_6^{3-}$, $MnO_4^{2-}/MnO_4^{-}$, and the like. Other suitable couples include $Cr^{3+}/Cr_2O_7^{2-}$, $Br^-/Br_2$, $I^-/I_2$, and the like.

Any suitable electrolytic solution may be employed for the aqueous phase to transport the redox couple, as long as the couple is maintained in solution. Further, the electrolyte of the aqueous phase should be electrochemically inert and chemically inactive. For example, strong acid solutions typically find use as the aqueous phase for the metal cation based redox couples. Depending on the specific redox couple present in a particular indirect electrochemical system, convenient electrolytes include $H_2SO_4$, $HNO_3$, $HClO_4$, $AcOH/H_2O$, $CH_3OH$, $CF_3COOH$, $CH_2Cl_2/H_2O/H_2SO_4$, and the like.

The ionomer films used in the electrodes of the subject invention will be characterized by the following properties. The films should be stable, i.e. chemically and electrochemically inert. The films should be physically adherent to the electrode surface. The films should be physically insoluble in the various phases which will contact it. Finally, the films should be permselective, in that they selectively allow passage of the redox couple to and from the electrode surface but significantly inhibit analogous passage of the organic contaminants. Both cationic and anionic ionomer films may be employed as the coating for the electrode. Further, films which comprise a mixture of both anionic and cationic ionomer constituents, such as a mixture of NAFION ® and TOSFLEX ®, to form a hybrid film may find use in particular indirect electrochemical systems. Ionomer films of particular interest include NAFION ®, TOSFLEX ®, the "Dow Experimental Ionomer," and the like.

The electrode material should be able to maintain high electric current efficiency in regeneration of the redox reagent. The particular material used will be dictated by both the choice of the electrolyte in the aqueous phase and the choice of the redox couple. Electrode materials which find particular use include carbon, platinum, and lead dioxide.

Any convenient formation of the coated electrode may be employed. Of particular interest are the formations where the electrode is coated with a thin ionomer film or, alternatively, where the electrode is electrodeposited within an ionomer film that coats an electronically conductive substrate.

Any suitable means for applying a potential between the ionomer-coated electrode and the counter-electrode may be employed, such as a battery. The potential applied should be sufficient to regenerate the redox couple, and may be determined empirically, depending on the particular redox couple used. In making electrodes with ionomer coatings, any convenient method for coating the electrode may be employed. Methods for coating electrodes with ionomer films are well known in the art and include dip coating, spin-coating, and the like.

An optimal coating thickness will exist for the ionomer coating. The optimal thickness of the ionomer coating is determined with respect to the following criteria. Thicker films provide greater protection of the electrode from the organic contaminants. However, thicker films also reduce the mass-transport flux of the spent redox reagent to the electrode surface for regeneration and the mass-transport flux of the regenerated redox reagent from the electrode surface. For example, under current control conditions, i.e. galvanostatic control, if the film is too thick, passage of the spent redox reagent to the electrode surface will be impeded and the overall electric current efficiency of regeneration of the redox reagent will diminish. In contrast, if the film is too thin, the organic contaminants present in the aqueous phase will still reach the surface of the electrode, and thus adversely affect the current efficiency. While optimal coating thickness is thus empirically determined, it will generally range from about 0.01 μm to 10 μm.

In an alternative embodiment of the subject invention, the ionomer coated electrode comprises an electronically conductive inert substrate coated with a thin ionomer coating in which the electrodes have been electrodeposited. This embodiment ensures that the requisite intimate contact exists between the ionomer coating and the electrode surface.

The substrate on which the ionomer film is coated must be electrically conductive, and chemically and electrochemically inert. The substrate serves to collect the applied current, support the film coating, and provide an anchor for the electrodeposited electrodes. Suitable substrates include glassy carbon, graphite, lead, lead dioxide and steel (for use as a cathode).

The substrate may be coated with the ionomer film by any convenient means, such as dip coating, spin coating and the like. The thickness of the ionomer coating on the substrate may range from 0.01 μm to 10 μm.

Operationally, the coated substrate may be submerged in an aqueous salt solution comprising an electrode forming metal complex ion. The electrode forming metal complex ion is typically a cation salt of a metal when a cationic ionomer film is used. When an anionic ionomer film is used, an anionic salt of a metal is preferred. For platinum electrodes, electrode forming metal complex ions include $Pt(NH_3)_4^{2+}$, $Pt(H_2O)_4^{2+}$, and the like. The electrode forming complex metal ions diffuse into the ionomer film upon immersion of the film coated electrode into the aqueous metal ion salt solution.

Following, the ionomer coated substrate may or may not be removed from the solution. A sufficient electric potential is then applied to the substrate whereby electrodes comprised of the reduced metal ion anchored to, and nucleated at, the substrate grow within the ionomer coating. Sufficient electrode potentials suitable for electrode formation will depend on the particular system being used. For example, where the electrode forming metal complex ion is $Pt(NH_3)_4^{2+}$ in a NAFION ® film, the electrode potential (vs. $Hg_2SO_4/Hg$ (MSE) reference electrode at pH≃7) ranges from −0.5 V to 1.5 V, more particularly −0.9 V to 1.4 V, particularly −1.1 V. Upon application of the potential to the substrate, the electrode forming metal complex ions diffused throughout the ionomer film are reduced on and nucleate on the substrate surface and grow into electrodes within the ionomer film. The electrodes may be electrodeposited to any convenient height above the substrate surface, but must not emerge from the surface of the film. Suitable thicknesses between the top of the formed electrode and the surface of the film range from about 0.01 μm to 10 μm.

The subject invention is now considered in light of the drawings which depict several preferred embodiments of the invention. FIG. 1 is a flow diagram illustrating the steps of an Ex-Cell indirect electrochemical process. The aqueous phase 1 comprising an oxidizing agent (not shown) is contacted with an organic phase 2 comprising an organic reactant (not shown) in a chemical reactor 3. Following formation of product and spent oxidizing agent, the organic and aqueous phases 4 are separated in phase separator 5 to form organic phase 6 comprising a product and aqueous phase 7 comprising the reduced oxidizing agent. Aqueous phase 7 enters electrochemical reactor 8 to regenerate the reduced oxidizing agent to its oxidizing form.

Figure 2:
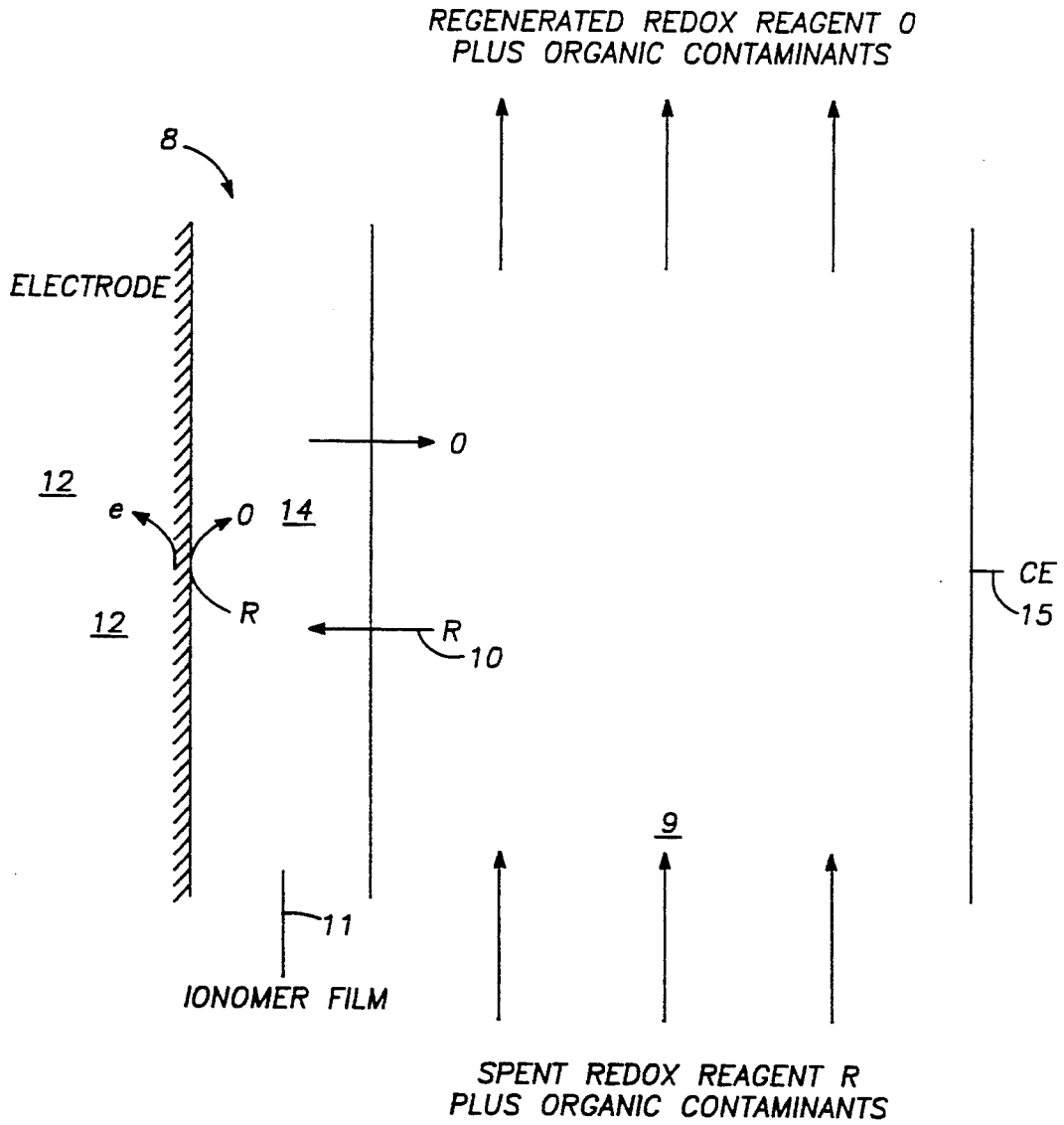
FIG. 2 depicts the regeneration of a redox reagent on an ionomer coated electrode.

FIG. 2 illustrates the regeneration of a reduced oxidizing reagent in an electrochemical reactor. The aqueous phase 9, comprising the reduced oxidizing agent 10, enters the reactor 8. The reduced oxidizing agent 10 passes through the ionomer film 11 to the anode 12. The reduce oxidizing agent 10 gives up an electron 12 to form an oxidizing agent 14. The oxidizing agent then passes through the ionomer film 11 to the aqueous phase 9. The cathode, or counter-electrode 15 of the chemical reactor 8 is opposite the ionomer film 11.

Figure 3:
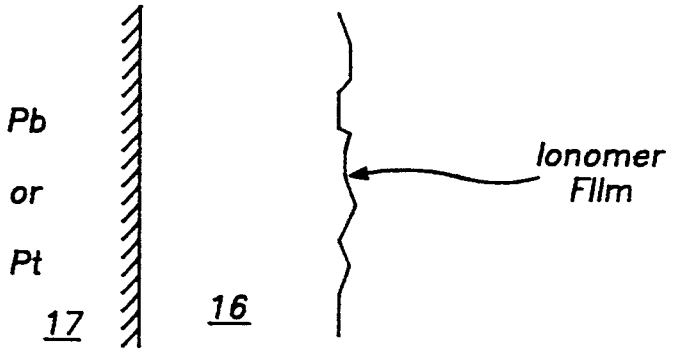
FIG. 3 is a schematic view of an ionomer coated electrode.
Figure 4:
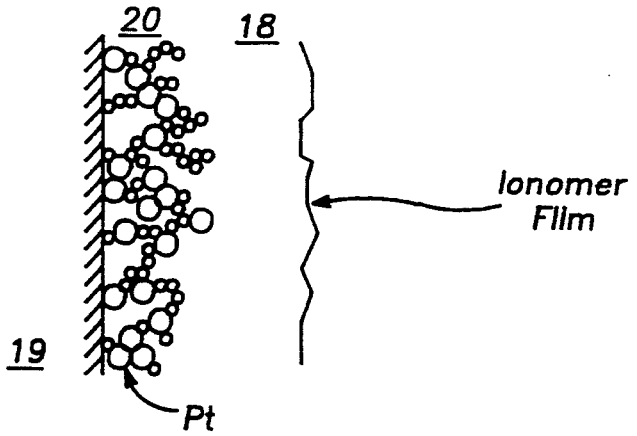
FIG. 4 is a schematic view of a platinum electrode electrodeposited within an ionomer film which coats a glassy carbon substrate.

FIG. 3 is a schematic view of ionomer coated electrode. The ionomer film 16 directly coats an electrode 17. FIG. 4 is schematic view of an alternative electrode embodiment. An ionomer film 18 coats a glassy carbon substrate 19. The platinum electrode 20 is electrodeposited on the glassy carbon substrate 18 within the ionomer film 19.

The following examples are offered by way of illustration and not by way of limitation.

EXPERIMENTAL

EXAMPLE 1

Preparation of NAFION ® coated platinum electrode for oxidation of $Fe^{2+}$

A 5-mm diameter platinum disk electrode (Pine Instrument Company) was polished on an Alpha cloth (Mark V Laboratory) to a mirror finish by using sequentially 1, 0.3, and 0.05 μm alumina.

A NAFION ® solution (5 w/w % of 1100 equivalent weight ionomer) was diluted to 3 w/w % (28 g/l) with isopropanol. A 10 μl drop of the 3% NAFION ® solution was applied with a syringe to the surface of the stationary disk which was placed on an inverted Pine rotator. The film was dried at room temperature under 200 rpm rotation for approximately 10 minutes. The NAFION ® coating was then thermally annealed to the electrode as described in Ye and Fedkiw, "A Comparison of Two Post-Casting Treatment Methods for Perfluoro Sulfonated Ionomer Films," (submitted for publication to Electrochim. Acta.). The thickness of the film near the center of the disk was 3.7±0.8 μm.

EXAMPLE 2

Comparison of kinetic parameters for $Fe^{2+}$ oxidation on NAFION ® coated and non-coated electrodes Since reaction current density is directly proportional to the rate constant, k°, and exponentially proportional to the anodic transfer coefficient, α, the anodic transfer coefficient and the standard rate constant were measured to quantitate the ability of the NAFION ® coating to prevent passage of organic contaminants to the electrode surface and yet maintain adequate current efficiency in the oxidation of $Fe^{2+}$. The kinetic parameters were obtained on a platinum electrode with aqueous phases comprising 50 mM $FeSO_4$ in 1M $H_2SO_4$. The results obtained are presented in Table 1.

TABLE 1

| Electrode Form | Aqueous phase Conditions | α | K.° (cm/sec) × $10^{-3}$ |
|---|---|---|---|
| non-coated | 50 mM $FeSO_4$ in 1 M $H_2SO_4$ | 0.39 | 3.4 |
| non-coated | 50 mM $FeSO_4$ in 1 M $H_2SO_4$ 7 mM toluene | 0.21 | 2.3 |
| non-coated | 50 mM $FeSO_4$ in 1 M $H_2SO_4$ 16 mM Benzoic Acid | 0.24 | 2.0 |
| NAFION ® coated | 50 mM $FeSO_4$ in 1 M $H_2SO_4$ & no organic contaminant | 0.86 | 0.43 |
| NAFION ® coated | 50 mM $FeSO_4$ in 1 M $H_2SO_4$ with toluene | 0.85 | 0.52 |
| NAFION ® coated | 50 mM $FeSO_4$ in 1 M $H_2SO_4$ with benzoic acid. | 0.73 | 0.24 |

Based on the above table, it was concluded that the NAFION ® film sufficiently buffered the surface of the electrode from the contaminating effect of toluene and benzoic acid.

EXAMPLE 3

Comparison of kinetic parameters for $Ce^{3+}/Ce^{4+}$ oxidation on NAFION ® coated and non-coated electrodes.

Using the electrode of Example 1, the kinetic parameters for the oxidation of $Ce^{3+}$ to $Ce^{4+}$ are measured for both non-coated electrodes and NAFION ® coated electrodes. The parameters are measured for oxidation of $Ce^{3+}$ to $Ce^{4+}$ in the following three aqueous phase compositions: 1) 1M $H_2SO_4$ 2) 1M $H_2SO_4$ with 7 mM toluene, and 3) 1M $H_2SO_4$ in 16 mM benzoic acid.

EXAMPLE 4

Oxidation of $Cr^{3+}$ to $Cr_2O_7^{2-}$ on an NAFION ®/Tosflex ® coated electrode.

NAFION ® and TOSFLEX ® are dissolved in low aliphatic alcohol to form a mixture that is equimolar with respect to ionic sites. The hybrid film is annealed and cast onto a platinum electrode in a thickness of 1 μm. A bulk solution, comprising 50 mM $Cr^{3+}$ in 1M $H_2SO_4$ is contacted to the surface of the coated electrode. $Cr^{3+}$ passes from the bulk solution across the Nafion ® moiety of the hybrid film to the electrode surface, where it is oxidized to $Cr_2O_7^{2-}$. The $Cr_2O_7^{2-}$ is then transported back to the bulk solution through the Tosflex ® moiety of the hybrid film.

It is evident from the above results that improved methods of indirect electrochemistry are provided by using ionomer coated electrodes for regeneration of the redox reagent. Use of these ionomer coated electrodes make indirect electrochemistry a viable tool for the CPI in carrying out homogenous chemical reactions.

All publications and patent applications cited in this specification are herein incorporated by reference as if each individual publication or patent application were specifically and individually indicated to be incorporated by reference.

Although the foregoing invention has been described in some detail by way of illustration and example for purposes of clarity of understanding, it will be readily apparent to those of ordinary skill in the art in light of the teachings of this invention that certain changes and modifications may be made thereto without departing from the spirit or scope of the appended claims.

What is claimed is:

1. A method of indirect electrochemistry, said method comprising the steps of:

contacting an aqueous phase with an organic phase, wherein said aqueous phase comprises a redox reagent and said organic phase comprises an organic reactant, to form a spent redox reagent and a product;

separating said aqueous phase from said organic phase; and contacting said aqueous phase with an electrode coated with an ionomer film and a counter electrode, wherein the potential between said ionomer coated electrode and counter electrode is sufficient to regenerate said spent redox reagent at said ionomer coated electrode;

whereby said spent redox reagent is converted to said redox reagent.

2. The method according to claim 1, wherein said ionomer film is cationic.

3. The method according to claim 2, wherein said ionomer film is a cationic perfluorinated membrane.

4. The method according to claim 1, wherein said ionomer film is anionic.

5. The method according to claim 4, wherein said ionomer film is an anionic perfluorinated membrane.

6. The method according to claim 1, wherein said ionomer film comprises a hybrid film of anionic and cationic constituents.

7. The method according to claim 6, wherein said hybrid film comprises a cationic perfluorinated membrane and an anionic perfluorinated membrane.

8. The method according to claim 1, wherein said ionomer film coats said electrode in a thickness ranging from about 0.01 μm to 10 μm.

9. The method according to claim 7, wherein said electrode is platinum.

10. The method according to claim 7, wherein said ionomer film is a cationic perfluorinated membrane.

11. The method according to claim 7, wherein said ionomer film is an anionic perfluorinated membrane.

12. A method of indirect electrochemistry, said method comprising the steps of:

contacting an aqueous phase comprising a redox reagent and an organic phase comprising an organic reactant to form a spent redox reagent and product;

separating said aqueous phase from said organic phase; and contacting said aqueous phase with a cationic perfluorinated membrane coated platinum electrode, wherein the thickness of said cationic perfluorinated membrane coating ranges from about 0.01 μm to 10 μm, and a counter electrode, wherein the potential between said cationic perfluorinated membrane coated electrode and counter electrode is sufficient to regenerate said spent redox reagent at said cationic perfluorinated membrane coated electrode;

whereby said spent redox reagent is converted to said redox reagent.

13. The method according to claim 1, wherein said electrode comprises:

a substrate;

an ionomer film coating said substrate; and electrodes electrodeposited within said ionomer film, wherein said electrodes are anchored to said substrate.

14. A method according to claim 13, wherein said substrate comprises an electronically conductive substrate.

15. A method according to claim 13, wherein said ionomer film is a cationic perfluorinated membrane.

16. A method according to claim 13, wherein said electrode comprises platinum.

17. A method of indirect electrochemistry, said method comprising the steps.of:

contacting an aqueous phase comprising a redox reagent and an organic phase comprising an organic reactant to form a spent redox reagent and product;

separating said aqueous phase from said organic phase; and contacting said aqueous phase to an ionomer coated electrode and a counter electrode, wherein the potential between said ionomer coated electrode and counter electrode is sufficient to regenerate said spent redox reagent at said electrode, wherein said ionomer coated electrode comprises an electronically conductive substrate, a cationic perfluorinated membrane film and an electrode, wherein said electrode is electrodeposited in said cationic perfluorinated membrane film and anchored to said electronically conductive substrate;

whereby said spent redox reagent is converted to said redox reagent.

* * * * *